US010895194B2

(12) United States Patent
Markin

(10) Patent No.: US 10,895,194 B2
(45) Date of Patent: Jan. 19, 2021

(54) COOLING SYSTEM, AND INTERNAL COMBUSTION ENGINE COMPRISING A COOLING SYSTEM OF SAID TYPE

(71) Applicant: MTU Friedrichshafen GmbH, Friedrichshafen (DE)

(72) Inventor: Oliver Markin, Markdorf (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 844 days.

(21) Appl. No.: 15/473,678

(22) Filed: Mar. 30, 2017

(65) Prior Publication Data

US 2017/0204776 A1 Jul. 20, 2017

Related U.S. Application Data

(63) Continuation of application No. PCT/EP2015/072748, filed on Oct. 1, 2015.

(30) Foreign Application Priority Data

Oct. 2, 2014 (DE) ..... 10 2014 014 718

(51) Int. Cl.
*F01P 11/02* (2006.01)
*F01P 11/04* (2006.01)
*F02B 39/00* (2006.01)

(52) U.S. Cl.
CPC ..... *F01P 11/0285* (2013.01); *F01P 11/029* (2013.01); *F01P 11/04* (2013.01); *F01P 2060/12* (2013.01); *F02B 39/005* (2013.01)

(58) Field of Classification Search
CPC . F01P 11/0285; F01P 3/20; F01P 3/00; F01M 11/02; F02B 39/005
See application file for complete search history.

(56) References Cited

U.S. PATENT DOCUMENTS 4,752,193 A * 6/1988 Horler ..... F01D 25/183 417/407
4,759,499 A 7/1988 Gusinde et al.
4,927,336 A * 5/1990 Rossmann ..... F01D 25/18 60/605.3
4,928,637 A 5/1990 Naitoh et al.
6,305,342 B1 * 10/2001 Narita ..... F01M 11/02 123/195 AC (Continued)

FOREIGN PATENT DOCUMENTS

DE 199 48 160 A1 4/2001
JP 2012-92751 A 5/2012

(Continued)

OTHER PUBLICATIONS

Machine generated translation of EP1832730A2.*

(Continued)

*Primary Examiner* — Ngoc T Nguyen
(74) *Attorney, Agent, or Firm* — Taylor IP, P.C.

(57) ABSTRACT

A cooling system including a first coolant line and a second coolant line, at least one first component to be cooled, into which the first coolant line opens, and a first ventilation line. The first ventilation line is fluidically connected to the at least one first component and is configured for ventilating the at least one first component. The first ventilation line opens into the second coolant line.

18 Claims, 4 Drawing Sheets

(56) References Cited

U.S. PATENT DOCUMENTS

| | | | | |
|---|---|---|---|---|
| 9,222,400 | B2 | 12/2015 | Kaulen et al. | |
| 2008/0110344 | A1 | 5/2008 | Follette et al. | |
| 2012/0174580 | A1 * | 7/2012 | Kuhlbach | F01D 25/14 60/616 |

FOREIGN PATENT DOCUMENTS

| | | | | |
|---|---|---|---|---|
| SU | 699211 | | 11/1979 | |
| WO | WO-0043651 | A1 * | 7/2000 | F02B 39/005 |

OTHER PUBLICATIONS

International Search Report and Written Opinion dated Dec. 2, 2015 for International Application No. PCT/EP2015/072748 (11 pages).

* cited by examiner

COOLING SYSTEM, AND INTERNAL COMBUSTION ENGINE COMPRISING A COOLING SYSTEM OF SAID TYPE

CROSS REFERENCE TO RELATED APPLICATIONS

This is a continuation of PCT application No. PCT/EP2015/072748, entitled "COOLING SYSTEM, AND INTERNAL COMBUSTION ENGINE COMPRISING A COOLING SYSTEM OF SAID TYPE", filed Oct. 1, 2015, which is incorporated herein by reference.

BACKGROUND OF THE INVENTION

1. Field of the Invention

The present invention relates to cooling systems, and, more particularly, to an internal combustion engine having a cooling system.

2. Description of the Related Art

A cooling system generally has a coolant circuit through which a liquid coolant flows for the purposes of absorbing heat from components to be cooled, for example of an internal combustion engine. During filling or refilling with coolant, or as a result of leaks that may exist in a cooling system, air pockets may form, which have an adverse effect on a level of cooling power of the cooling system. For this purpose, in the case of known cooling systems, it is provided that a ventilation line is fluidically connected to a component to be cooled, to which coolant is supplied via a coolant line, for the purposes of ventilating the component. Here, the ventilation line is different from the coolant line and serves not for the supply of coolant but rather specifically for the ventilation of the component. The ventilation line is typically led to a bubble separator of the cooling system, into which a plurality of ventilation lines extending from different components generally open, or the ventilation line is led into an expansion tank for the coolant circuit, wherein the air can be separated from the coolant in the bubble separator or in the collecting tank. To reach the bubble separator or the expansion tank, long ventilation lines are required in any case from components which are arranged further remote therefrom. These long ventilation lines generally must be laid in a complex fashion on an internal combustion engine. This gives rise to considerable design, manufacturing, assembly and qualification outlay, and high development costs. Furthermore, accessibility to such long lines cannot be ensured everywhere, which either makes the assembly process cumbersome and expensive or necessitates a potential redesign. To make the ventilation lines less susceptible to vibrations and to possibly resulting breakage, they must be mounted at regular intervals. This has the effect that long ventilation lines are fastened to various components, wherein tolerances must be compensated, or an absence of a possibility of tolerance compensation can lead to defects in a series assembly process. If the ventilation lines are installed under stress, this can lead to breakage of the lines during operation. A further problem arises whereby mounting of ventilation lines at desired locations is often not possible because other components are in the way. It is then necessary for the ventilation lines to cover relatively large distances in a freely suspended state. Here, the susceptibility of the ventilation lines to oscillation increases with their freely suspended length. It is a further problem that, in the case of a central infeed into a bubble separator or expansion tank, the various ventilation lines must be assigned apertures which, by means of different diameters, ensure that different pressure levels of the components to be ventilated are equalized. Here, it is generally necessary to use apertures with a flow diameter of 1 mm or less, wherein high flow resistances arise, and there is a risk of blockage, for example if particles are present in the coolant.

What is needed in the art is an internal combustion engine having a cooling system wherein the stated disadvantages do not arise.

SUMMARY OF THE INVENTION

The present invention provides a cooling system which has at least one first component to be cooled, into which a first coolant line opens, wherein a first ventilation line which is different from the first coolant line is fluidically connected to the first component for the purposes of ventilation of the first component. Here, it is provided that the first ventilation line opens into a second coolant line. The ventilation line extending from the first component is thus led not to a central infeed point such as an expansion tank or a bubble separator but rather—in decentralized fashion—into a second coolant line, such that the air discharged from the first component can be conveyed onward through the second coolant line along the coolant circuit. By this decentralized configuration, it is possible for the ventilation line, for example even in the case of the first component to be cooled being arranged remote from an expansion tank, to be of shorter form than if a central introduction point and a merging of multiple ventilation lines were provided. In this way, disadvantages associated with long ventilation lines—in particular of a design nature and with regard to mounting and susceptibility to oscillations—can be at least substantially—or even entirely—avoided. Furthermore, there is no longer a risk of apertures being interchanged. Rather, it is possible for identical aperture diameters to be used for different ventilation lines, such that identical parts can be used. Since there is no longer a need for equalization of different pressure levels of a multiplicity of components at a central introduction point, it is also possible for aperture diameters to be selected to be larger, such that a risk of blockage by particles present in the coolant is avoided.

The cooling system may be designed for the use of a liquid coolant. Here, the expression "liquid" means that, under the conditions prevailing in the cooling system, for example the pressures and temperatures prevailing there during operation, the coolant is present in the liquid state of aggregation. The coolant may be in liquid form under normal conditions, that is to say for example at 1013 mbar and 25° C. Such coolants may have a higher heat capacity than, for example gaseous coolants. They can therefore transport greater quantities of heat with a relatively small volume and/or mass flow, and thereby permit more efficient cooling. The cooling system may be designed for the use of water, for example in a mixture with at least one antifreeze agent, for example glycol, as coolant. Here, water is characterized by a high heat capacity. There is however the problem that the heat capacity of a mixture of coolant and air present in a line section under consideration is reduced in relation to pure coolant, and thus the efficiency of the cooling is reduced. Furthermore, air cushions can form at geodetically high points of components to be cooled, which air cushions may possibly considerably reduce a coolant throughflow or even bring such a throughflow to a complete standstill. Therefore, in order to improve the cooling power of a cooling system of such type, ventilation of components to be cooled is generally necessary.

A component to be cooled is to be understood to mean a part, for example a component or functional part, of a device which is to be cooled by the cooling system. For example, this may be a part, component or functional part of an internal combustion engine, such as a turbine housing or a compressor housing of an exhaust-gas turbocharger or a crankcase.

A coolant line is to be understood to mean a line which is designed for conducting coolant, specifically for supplying, conducting and/or discharging coolant to, through or from a component to be cooled for the purposes of cooling the component to be cooled. Here, a coolant line may be designed, in terms of its cross section, such that a component to be cooled can be flowed through with a mass or volume flow of coolant adequate for the cooling of the component. Such a coolant line may be formed as a line which is separate from the component to be cooled but which is fluidically connected thereto, or else as a coolant path within a component to be cooled, for example through a housing of double-walled form. Coolant lines may be arranged such that effective and efficient coolant guidance—for example with regard to a pressure loss, a flow speed, cavitation and other relevant conditions—to all components to be cooled is ensured.

A ventilation line is to be understood to mean a line which is provided for the ventilation of a component to be cooled and which may be designed for discharging air or a coolant/air mixture from the component to be cooled. Here, a coolant/air mixture discharged from the component to be cooled by the ventilation line for the purposes of ventilation is richer in air than a coolant/air mixture possibly flowing through a coolant line. For the purposes of efficient ventilation, the ventilation line may be arranged on the component to be cooled such that substantially air is supplied to the component, wherein it is however possible for coolant to be entrained by air bubbles passing into the ventilation line. As a result, concentration of air occurs in the ventilation line in any case in relation to the coolant line, and the coolant component in the mixture conducted through the ventilation line is considerably lower than in the coolant line. Since, furthermore, the ventilation line does not have to conduct a mass or volume flow of the coolant which is sufficient for cooling the component to be cooled, the ventilation line may have a smaller cross section than the coolant line. Ventilation lines may be arranged on a component to be cooled such that suitable pressure levels are achieved or maintained in order to ensure a flow of the coolant. Furthermore, the ventilation lines may be designed to be as short as possible.

Here, ventilation is to be understood to mean that air is discharged from a coolant line assigned to a component to be cooled, or from a coolant path of the coolant line, in order to improve the efficiency of the cooling and the throughflow of the coolant through the component to be cooled.

Ventilation lines may be, where possible, laid so as to have a rising gradient in order to ensure effective ventilation.

At least two lines may be fluidically connected to the first component to be cooled, specifically the first coolant line, on the one hand, and the first ventilation line, which is different from and may also be separate from, that is to say, for example, arranged separately from, the first coolant line. The coolant line, by contrast to the ventilation line, is designed for supplying a mass or volume flow of coolant to the component to be cooled, which mass or volume flow is adequate for the cooling of the component. The ventilation line is designed to ensure ventilation of the first component. The component to be cooled is may be additionally fluidically connected to a further coolant line—as a third line—via which coolant is discharged after having flowed through the component to be cooled. The ventilation line thus serves not for the discharge of coolant but rather for the ventilation, for example exclusively for the ventilation.

The ventilation line may be fluidically connected to a coolant path within the first component. A coolant path of such type, which itself also constitutes a coolant line, may be formed by a double-walled or multi-walled housing of the first component. By virtue of the fact that the ventilation line opens into the coolant path, the first component can be ventilated highly efficiently. The first ventilation line branches off from the first component, for example from the coolant path, or proceeds from the first component to be cooled, for example from the coolant path.

The first ventilation line may open—for example downstream of the first component—into the second coolant line, wherein here, the expression "downstream" relates to the flow direction of the air discharged from the first component. The air or the air-rich coolant/air mixture is thus discharged from the first component along the first ventilation line and introduced into the second coolant line.

The second coolant line may be arranged downstream of the first coolant line in relation to a coolant circuit of the cooling system. It is possible for the second coolant line—as a third line—to be branched off from the first component to be cooled and/or to be directly fluidically connected thereto in order to discharge coolant from the first component to be cooled. It is furthermore possible for the second coolant line to not be directly fluidically connected to the first component to be cooled but rather to be arranged fluidically in series with and downstream of the first component to be cooled in the coolant circuit of the cooling system. It is however also possible for the second coolant line to be arranged in the cooling system in parallel with respect to the first coolant line, for example in a parallel cooling branch of the cooling system.

The second coolant line may further be in the form of a coolant path in a second component to be cooled. This means that a second component to be cooled is provided which has an integral coolant path, for example formed by a double-walled housing of the second component, as second coolant line, wherein the first ventilation line opens into the coolant path. The air discharged from the first component to be cooled can thus be conducted, in the second component to be cooled, into the coolant circuit again, and transported onward from there—possibly via further coolant lines. For example, if the first component and the second component are arranged adjacent to one another, this yields very short ventilation lines.

Alternatively, it is possible for the first ventilation line to open into the second coolant line outside a component to be cooled. Thus, an embodiment is also possible in which the ventilation line opens into a coolant line which does not extend through a component to be cooled but which rather leads to a component to be cooled or away from a component to be cooled. It is likewise possible for the second coolant line to lead to an expansion tank of the cooling system and may be directly fluidically connected thereto. It is furthermore possible for the second coolant line to lead to an air separator of the cooling system and may be directly fluidically connected thereto.

In another embodiment of the present invention, it is provided that, during the operation of the cooling system, a first pressure prevails in the first coolant line, wherein a second pressure prevails in the second coolant line. The first pressure may be higher than the second pressure. The coolant may be conveyed along the cooling system, and along a coolant circuit of the cooling system, by means of pressure differences. Here, a flow direction of the coolant is predefined for example by different pressure levels within the cooling system. By virtue of the pressure in the second coolant line being lower than the pressure in the first coolant line during the operation of the cooling system, it is ensured that the air extracted from the first component to be cooled is conveyed away from the component and is fed into the second coolant line, such that a defined flow direction is realized in terms of the ventilation. The ventilation of the first component to be cooled is thus realized in pressure-driven fashion.

In another embodiment of the present invention, it is provided that the first coolant line has a first cross-sectional area, wherein the first ventilation line has a second cross-sectional area. The first cross-sectional area may be larger than the second cross-sectional area. This is advantageous because it is the intention for the ventilation line to serve only for the ventilation of the first component to be cooled, whereas the first coolant line is provided for supplying a mass or volume flow of coolant to the first component to be cooled, which mass or volume flow is sufficient for the cooling of the component. The correspondingly selected cross-sectional areas may ensure that the various lines can satisfy their various requirements, and furthermore also that an excessively large coolant flow is not undesirably conveyed along the ventilation line, which could otherwise result in deficient functioning of the cooling system.

Alternatively or in addition, the second coolant line may have a third cross-sectional area which is larger than the second cross-sectional area of the first ventilation line.

The first and/or third cross-sectional area are/is larger than the second cross-sectional area for example by a factor of at least 16, such as of at least 16 to at most 400, for example of at least 25 to at most 225, for example of at least 36 to at most 100, for example of at least 25 to at most 49, for example of at least 25 to at most 36. It is correspondingly the case that the first and/or the second coolant line, in the case of a circular cross section, have/has a first and/or third diameter or radius respectively, wherein the first ventilation line—likewise in the case of a circular cross section—has a second diameter or radius, wherein the first and/or the third diameter or radius are/is larger than the second diameter or radius, specifically for example by a factor of at least 4, for example to at most 20, for example of at least 5 to at most 15, for example of at least 6 to at most 10, for example of at least 5 to at most 7, for example of at least 5 to at most 6.

It is possible for the first cross-sectional area of the first coolant line and the third cross-sectional area of the second coolant line to be of equal size; it is however also possible for them to be of different size. They may furthermore be of identical or different shapes or geometries.

In another embodiment of the cooling system, a coolant line may have a line diameter of 40 mm or greater. A ventilation line may have a line diameter of at least 5 mm to at most 10 mm, for example of at least 6 mm to at most 8 mm, for example of 7 mm.

In general, it is found that the cross section of a ventilation line is generally selected independently of the coolant volume flow required for a component to be cooled. By contrast, use is may be made here of as small a pipeline size as possible, in order to keep the coolant flow along the ventilation line small, because the coolant flow cannot be utilized for cooling purposes.

In another embodiment of the present invention, it is provided that the first ventilation line is fluidically connected to the first component to be cooled at a connection point which is arranged higher than, that is to say in geodetically above, the opening-in point of the first coolant line into the first component to be cooled. The expression "geodetically above" is to be understood here to mean that a direction is predefined by the gravitational force, this also being referred to as vertical direction, wherein, when the cooling system is in the intended arrangement, a side of the cooling system facing toward the Earth's center is referred to as being geodetically at the bottom, and a side averted from the Earth's center is referred to as being geodetically at the top. The fact that the connection point for the first ventilation line is thus arranged geodetically above the opening-in point of the first coolant line means that—as viewed in a vertical direction—the connection point is arranged above the opening-in point of the first coolant line. In this way, it is ensured that air which flows into the first component through the first coolant line can rise upward, wherein, above the opening-in point of the first coolant line, the air can escape into the ventilation line. The connection point for the ventilation line is may be arranged at a geodetically highest point of the first component. This has an advantage that air situated in the first component can collect at the geodetically highest point and can be discharged from there through the ventilation line. It is thus possible for the formation of an air cushion at the geodetically highest point of the first component to be prevented.

It is possible for the first coolant line to open into the first component geodetically at a bottom side thereof. The coolant then flows within the first component to be cooled from bottom to top and—depending on the opening-in point of a coolant line which discharges the coolant from the first component—downward again, or the coolant is discharged from the first component at a point situated geodetically above the opening-in point of the first coolant line.

The opening-in point of the first ventilation line into the second coolant line may be realized at a point situated geodetically at the bottom or at a point situated geodetically at the top, for example into a second component to be cooled. An advantage of an opening-in point geodetically at the top into a coolant path of a second component to be cooled is that the air entering the coolant path does not then have to rise up in the second component, but can remain geodetically at the top, and may be discharged here from the second component again by means of a further ventilation line.

In another embodiment of the present invention, it is provided that the cooling system has an air separator which—in relation to the flow direction of the coolant—is arranged downstream of the opening-in point of the first ventilation line into the second coolant line. The air separator may be arranged fluidically in series with the second coolant line, wherein the second coolant line either opens directly into the air separator, or wherein the air separator is arranged downstream of the second coolant line as viewed in a flow direction of the coolant. A second ventilation line is fluidically connected to the air separator. It is thus possible by the air separator for air that is delivered along the second coolant line to be separated from coolant that is likewise conveyed along the second coolant line and to be discharged through the second ventilation line.

An air separator is to be understood to mean a device which is designed to separate air encompassed by a fluid flow from liquid constituents of the fluid flow. The air separator is may be designed to supply the separated-off air to the second ventilation line and thereby ventilate the coolant circuit of the cooling system. This is not opposed by the fact that, in practice, complete separation of air and coolant may not occur in the air separator, wherein it is also possible for liquid coolant to pass with the separated-off air into the second ventilation line. The air/coolant mixture that is conducted in the second ventilation line is however in any case richer in air, and has less coolant, than the coolant/air mixture flowing into the air separator. Correspondingly, a coolant/air mixture flowing downstream of the air separator in a coolant line proceeding from the air separator is richer in coolant, and has less air, than the coolant/air mixture flowing into the air separator.

The air separator may have a separation means which is designed to separate off air from a coolant flow passing through the air separator and supply the air to the second ventilation line. The separation means may be formed as a lip or lamella which is arranged in the coolant flow passing through the air separator. The lip or lamella may be arranged so as to be impinged on by the air component and the liquid coolant component of the coolant flow in such a way as to be passed on a first side by the air component and on a second side by the liquid coolant, such that the air separated off on the first side of the lip or lamella can be removed from the coolant circuit. The lip or lamella may be arranged on a geodetically topside of the air separator and projects from there into the coolant flow obliquely and counter to the flow direction of the coolant. Above the lip or lamella, an orifice may be provided in the air separator, into which orifice the second ventilation line opens. In this way, air can be skimmed off from the coolant flow, and supplied to the second ventilation line, by the lip or lamella.

The lip or lamella may be of a spoon-like form, resulting in a skimming-off action for air. Here, it is the case that air components which generally flow geodetically at the top are skimmed off, such that these air components flowing at the top are discharged by the spoon-like lamella or lip on the first side thereof, wherein the coolant flow impinging on the lip or lamella—if it collides with the lip or lamella—is repelled by the spoon shape in a turbulent movement and washes past the second side of the lip or lamella.

The air separator may be integrated into a coolant line of the cooling system or directly fluidically connected to a coolant line, for example to the second coolant line. The air separator is thus incorporated into the coolant circuit. In this way, too, the cooling system can be made very compact.

The separation means of the air separator may have a material, or is composed of a material, selected from a group comprising aluminum, copper, steel, plastic, rubber, carbon, a metal alloy and a composite material.

The cooling system may include a coolant circuit with coolant lines for conveying the coolant along the coolant circuit, at least one component to be cooled, a heat exchanger for cooling the coolant, wherein the coolant flows along the coolant circuit both through the at least one component to be cooled and through the heat exchanger, and at least one conveying device for conveying the coolant along the coolant circuit. The conveying device may be formed as a pump. For example, the conveying of the coolant along the coolant circuit may be realized by generation of different pressure levels in the coolant circuit and by conveyance of the coolant along pressure gradients.

The air separator is may be arranged in a region of the coolant circuit which has a pressure level lower than one corresponding to the highest pressure level of the coolant circuit—for example directly downstream of the conveying device—for example in a region of the coolant circuit which has the lowest pressure level. It is then possible in an efficient manner for air to be discharged by a rising, second ventilation line which opens into the air separator.

In another embodiment of the present invention, it may be provided that the opening-in point of the first ventilation line into the second coolant line is arranged spaced apart from the air separator such that the air introduced into the second coolant line through the first ventilation line can rise up in the second coolant line on the flow path to the air separator, and can collect in a geodetically upper region thereof. At the same time, the opening-in point of the first ventilation line into the second coolant line may be provided as close as possible to the air separator, such that the air introduced into the second coolant line is conducted over as short a distance as possible along the coolant circuit. The spacing of the opening-in point from the air separator also ensures that air already situated in the second coolant line is not made turbulent. At the same time, it may be ensured that the air is not introduced into a flow dead zone via the opening-in point of the first ventilation line into the second coolant line, because otherwise an air cushion could form at the location of the opening-in point.

In another embodiment of the present invention, it is provided that the second coolant line and/or the second ventilation line open into an expansion tank of the cooling system for coolant. This has an advantage that air introduced into the expansion tank via the second coolant line and/or the second ventilation line can rise up in the expansion tank and be separated from the coolant.

Here, an expansion tank is to be understood to mean a reservoir for the coolant, which reservoir serves for compensating pressure and/or temperature fluctuations in the cooling system by virtue of the fact that coolant from the expansion tank can be fed into the coolant circuit or can be returned from the coolant circuit into the expansion tank. Here, the expansion tank may be a constituent part of the coolant circuit.

Another embodiment of the cooling system includes a coolant circuit with an expansion tank which may be a constituent part of the coolant circuit. The expansion tank itself is not a coolant line or ventilation line. The expansion tank is may be fluidically connected to at least one coolant line and/or at least one ventilation line.

It is possible for the cooling system to have more than one first component to be cooled. In addition or alternatively, it is possible for the cooling system to have more than one second component to be cooled. The cooling system may have a multiplicity of coolant lines and/or ventilation lines. Here, in addition to at least one ventilation line which opens into a further coolant line and/or a further component to be cooled, at least one ventilation line may also be provided which opens directly into the expansion tank. Here, it is possible for a ventilation line of such type not to have a direct fluidic connection to the air separator. Furthermore, it is possible for one coolant line into which a ventilation line opens to be connected to the air separator, wherein a different coolant line into which a ventilation line opens is connected, bypassing the air separator, to the expansion tank. Direct ventilation to the expansion tank is possible from components to be cooled which are arranged in relatively close proximity to the expansion tank, whereas ventilation of components to coolant lines or to other components to be cooled may be implemented in the case of components which are arranged spatially further remote from the expansion tank. In this way, it is possible to use short ventilation lines, and also ventilation lines which are of a similar length for all components.

The cooling system proposed here is suitable for use on different internal combustion engines and/or vehicles, because adaptation work for a specific usage situation, for example on a test stand, and associated development and/or design work or corresponding development iterations for the purposes of reducing occurrences of oscillation in respective ventilation lines can be avoided.

It is possible for coolant that has been freed from air components by the air separator to be conducted directly into the expansion tank. Alternatively or in addition, it is possible for such coolant to be supplied from the air separator directly to a component to be cooled, without previously passing the expansion tank.

The second coolant line may be arranged in closer proximity to the expansion tank than the first component to be cooled. The air that is discharged from the first component is thus, when fed in, conveyed into the second coolant line closer to the expansion tank, and thus simultaneously along the pressure gradient to a lower pressure level.

The second component to be cooled may be arranged in closer proximity to the expansion tank than the first component to be cooled. The air that is discharged from the first component is thus, when fed in, conveyed into the second component closer to the expansion tank, and thus simultaneously along the pressure gradient to a lower pressure level.

It is possible for air discharged from the first component to be supplied to a second component, to in turn be discharged therefrom, and to subsequently be supplied to a third component, wherein this may be continued until the air is finally supplied to the air separator and/or to the expansion tank. It may however alternatively also be provided that, for the air discharged from the first component, only exactly one intermediate station in the form of the second component is provided, such that, after passing the second component, the air is supplied directly to the air separator and/or to the expansion tank.

The first component to be cooled may be formed as a turbine housing of an exhaust-gas turbocharger. The second component to be cooled may be formed as a compressor housing of the exhaust-gas turbocharger. It is thus possible to provide a short ventilation line which branches off from the first component, specifically the turbine housing, and opens into the second component, specifically the compressor housing directly adjacent to the turbine housing.

It is also possible for the first component to be formed as a crankcase of an internal combustion engine.

Since the relatively short ventilation lines provided in the cooling system are less susceptible to oscillations than relatively long ventilation lines, the ventilation lines can be manufactured from solid materials, for example from metal or a plastic. As material, the ventilation lines may also be made of steel.

The cooling system may be compact and may be configured with the least possible number of short ventilation lines.

The cooling system may be designed as a closed, permanently ventilated system.

By an arrangement of the air separator in or on a coolant line of the cooling system, the coolant line, and also the cooling system as a whole, is permanently and, during operation, continuously ventilated. This means that, at all times during operation of the cooling system, the coolant flows on or through the at least one air separator, and air components present in the coolant flow may be separated off.

The cooling system may operate in closed fashion, for example designed as a closed, permanently ventilated system, such that the separated-off air is not released directly to an atmosphere, but rather is stored in a collecting vessel. A closed cooling system makes it possible to realize a higher pressure than in the case of an open system, such that a corresponding coolant has a higher boiling point, whereby it is in turn possible for an admissible coolant temperature to be increased.

The present invention in another form is directed to an internal combustion engine which has a cooling system according to one of the above-described exemplary embodiments. Here, the advantages that have already been discussed in conjunction with the cooling system are achieved in conjunction with the internal combustion engine.

The internal combustion engine may be in the form of a reciprocating-piston engine. It is possible for the internal combustion engine to be designed for driving a passenger motor vehicle, a heavy goods motor vehicle or a utility vehicle. In another embodiment, the internal combustion engine serves for driving heavy land vehicles or watercraft, for example mining vehicles and trains, wherein the internal combustion engine is used in a locomotive or in a power car, or in ships. Use of the internal combustion engine for driving a vehicle used for defense purposes, for example a tank, is also possible. Another embodiment of the internal combustion engine may also be used in a static situation, for example for static energy supply for emergency-power operation, continuous-load operation or peak-load operation, wherein the internal combustion engine in this case drives a generator. A static use of the internal combustion engine for driving auxiliary assemblies, for example fire extinguishing pumps on drilling platforms, is also possible. A use of the internal combustion engine in the field of the conveyance of fossil resources, for example fuels such as oil and/or gas, is furthermore possible. A use of the internal combustion engine in the industrial sector or in the construction sector, for example in a construction or building machine, for example in a crane or in a digger, is also possible. The internal combustion engine may be in the form of a diesel engine, a gasoline engine, a gas engine for operation with natural gas, biogas, special gas or some other suitable gas. For example, if the internal combustion engine is in the form of a gas engine, it is suitable for use in a cogeneration plant for static energy generation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
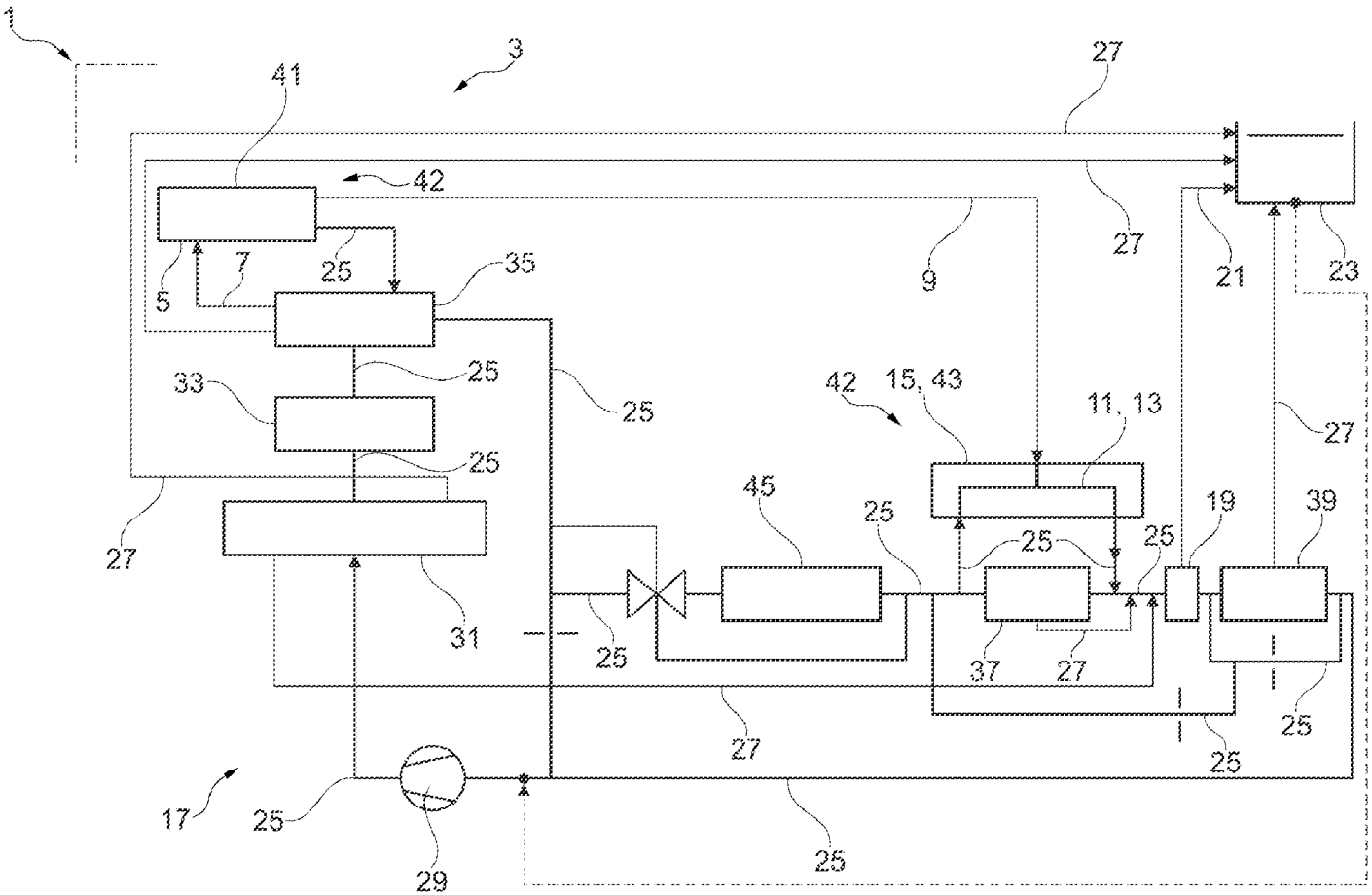
FIG. 1 is a schematic illustration of an embodiment of an internal combustion engine with a cooling system.

FIG. 1 is a schematic illustration of a first exemplary embodiment of an internal combustion engine 1 with a cooling system 3. The cooling system 3 has a first component 5 to be cooled, into which a first coolant line 7 opens. A first ventilation line 9, which is different from the first coolant line 7, is fluidically, i.e. fluidly, connected to the first component 5 for the purposes of ventilating the latter. The first ventilation line 9 opens into a second coolant line 11.

Here, the second coolant line 11 is formed as a coolant path 13 which is formed in a second component 15 to be cooled, for example in the form of a double-walled housing of the second component 15.

Alternatively, it is also possible for the first ventilation line 9 to open, outside a component to be cooled, into a coolant line of a coolant circuit 17 of the cooling system 3. This even constitutes a variant, because then no further component is impinged on by the air ventilated from another component. However, if a geometric distance of the component to be ventilated from a skimming-off component and/or an expansion tank of the cooling system 3 is too great, it may be advantageous, with regard to ventilation lines which are as short as possible and which exhibit little susceptibility to vibrations, for ventilation to be performed into a more closely situated, further component to be cooled. By contrast, if the component to be ventilated is arranged in close proximity to an expansion tank, ventilation can be performed directly into the expansion tank.

During the operation of the cooling system 3, a first pressure prevails in the first coolant line 7, which first pressure is higher than a second pressure which prevails in the second coolant line 11. The ventilation of the first component 5 may thus take place in pressure-driven fashion.

The first and/or the second coolant line 7, 11 have/has a first cross-sectional area, wherein the first ventilation line 9 has a second cross-sectional area, wherein the first cross-sectional area may be larger than the second cross-sectional area, for example by a factor of at least 16, for example to at most 400, for example of at least 25 to at most 225, for example of at least 36 to at most 100, for example of at least 25 to at most 49, for example of at least 25 to at most 36.

Here, the cooling system 3 has an air separator 19, which is arranged downstream of the opening-in point of the first ventilation line 9 into the second coolant line 11. A second ventilation line 21 is fluidically connected to the air separator 19. The air separator 19 has a separation means which is designed for separating off air from a coolant flow passing through the air separator 19 and supplying the air to the second ventilation line 21.

The second ventilation line 21 opens in this case into an expansion tank 23 of the cooling system 3 for coolant. Here, the expansion tank 23 serves for the compensation of thermally induced volume fluctuations of the coolant in the coolant circuit 17, and as a bubble separator or separating device in which air can rise up and escape from the coolant and consequently be discharged from the coolant circuit 17. Here, the cooling system 3 may be formed as an open system or else as a closed system, wherein, in the latter case, the air is not discharged to the atmosphere but rather is collected in the expansion tank 23.

The arrangement of the various components 5, 15 illustrated in FIG. 1 does not reflect the actual spatial arrangement thereof on the internal combustion engine 1, but rather serves for explaining the structure of the cooling system 3 and of the coolant circuit 17. For example, the second component 15 may be arranged in close proximity to the first component 5. Furthermore, the second component 15 may be arranged spatially closer to the expansion tank 23 than the first component 5.

In the exemplary embodiment in FIG. 1, the coolant circuit 17 of the cooling system 3 includes the following elements: a multiplicity of further coolant lines are in this case denoted as a whole by the reference designation 25, in order to simplify the illustration. Furthermore, additional ventilation lines are provided, which in this case, for the sake of simplicity, are all denoted by the reference designation 27.

The coolant is conveyed along the coolant circuit 17 by a conveying device 29 which may be in the form of a pump. Here, the coolant circuit 17 includes, as components to be cooled, a crankcase 31 of the internal combustion engine 1, a cylinder head 33 of the internal combustion engine 1, an exhaust line 35, a charge-air cooler 37, an oil heat exchanger 39, and the abovementioned first component 5 to be cooled, which in this case is formed as a turbine housing 41 of an exhaust-gas turbocharger 42, and the second component 15 to be cooled, which in this case is formed as a compressor housing 43 of the exhaust-gas turbocharger 42.

In the exemplary embodiment illustrated here, it is thus the case that the turbine housing 41 is ventilated via the first ventilation line 9 into the compressor housing 43.

The coolant circuit 17 furthermore has a coolant heat exchanger 45 for the purposes of cooling the coolant.

It is now shown that certain components can be ventilated into other components, in this case the turbine housing 41 can be ventilated into the compressor housing 43, wherein the air that is then ventilated into the second coolant line 11 is transported onward via the second coolant line and is finally fed again, between the charge-air cooler 37 and the air separator 19, into a further coolant line 25 which leads to the air separator 19, wherein the air is then separated off from the coolant flow in the air separator 19 and supplied via the second ventilation line 21 to the expansion tank 23.

Other components, which may be arranged in closer proximity to the air separator 19, may be ventilated directly into the coolant line 25, which is fluidically connected directly to the air separator 19, between the charge-air cooler 37 and the air separator 19, without the ventilated air previously being conducted through a further component to be cooled. This is the case for example with the charge-air cooler 37 itself and with the crankcase 31. The ventilated air or the air/coolant mixture flowing along the ventilation line 27 is, upstream of the air separator 19 and spaced apart from the latter, fed into the coolant line 25, in order that the air has time to rise up in the coolant line 25 before reaching the air separator 19 and to thus be separated off particularly efficiently in the air separator 19.

Further components to be cooled, for example components which are arranged in relatively close proximity to the expansion tank 23, are ventilated directly via ventilation lines 27 into the expansion tank 23. This is additionally the case here in particular for the crankcase 31, for the exhaust line 35 and for the oil heat exchanger 39.

In general, the ventilation lines 9, 21, 27 may be led so as to be of the shortest possible form, such that they do not exhibit a tendency to oscillate. Furthermore, the number of ventilation lines 9, 21, 27 can be considerably reduced in relation to known embodiments of a cooling system.

The expansion tank 23 can be arranged at a geodetically highest point of the cooling system 3, such that the air can rise up to the expansion tank 23 through the ventilation lines 21, 27, wherein a backflow of air into the ventilation lines 21, 27 is prevented.

It is also shown that a further coolant line 25 branches off, as a third line, from the first component 5 to be cooled in order to again discharge the coolant, which is supplied through the first coolant line 7 for cooling purposes, from the component 5 to be cooled. Here, it is clear that the first ventilation line 9 serves neither for the supply nor for the discharge of coolant, but rather in fact serves specifically for ventilation of the first component 5. This is not opposed by the fact that coolant entrained by the ventilated air may possibly also be conducted along the ventilation line 9. The air/coolant mixture that is conducted along the first ventilation line 9 is in any case very much richer in air, and at the same time has less coolant, than a coolant/air mixture possibly discharged from the first component 5 along the coolant line 25, if the coolant conducted along the coolant line 25 still contains any air at all.

Figure 2:
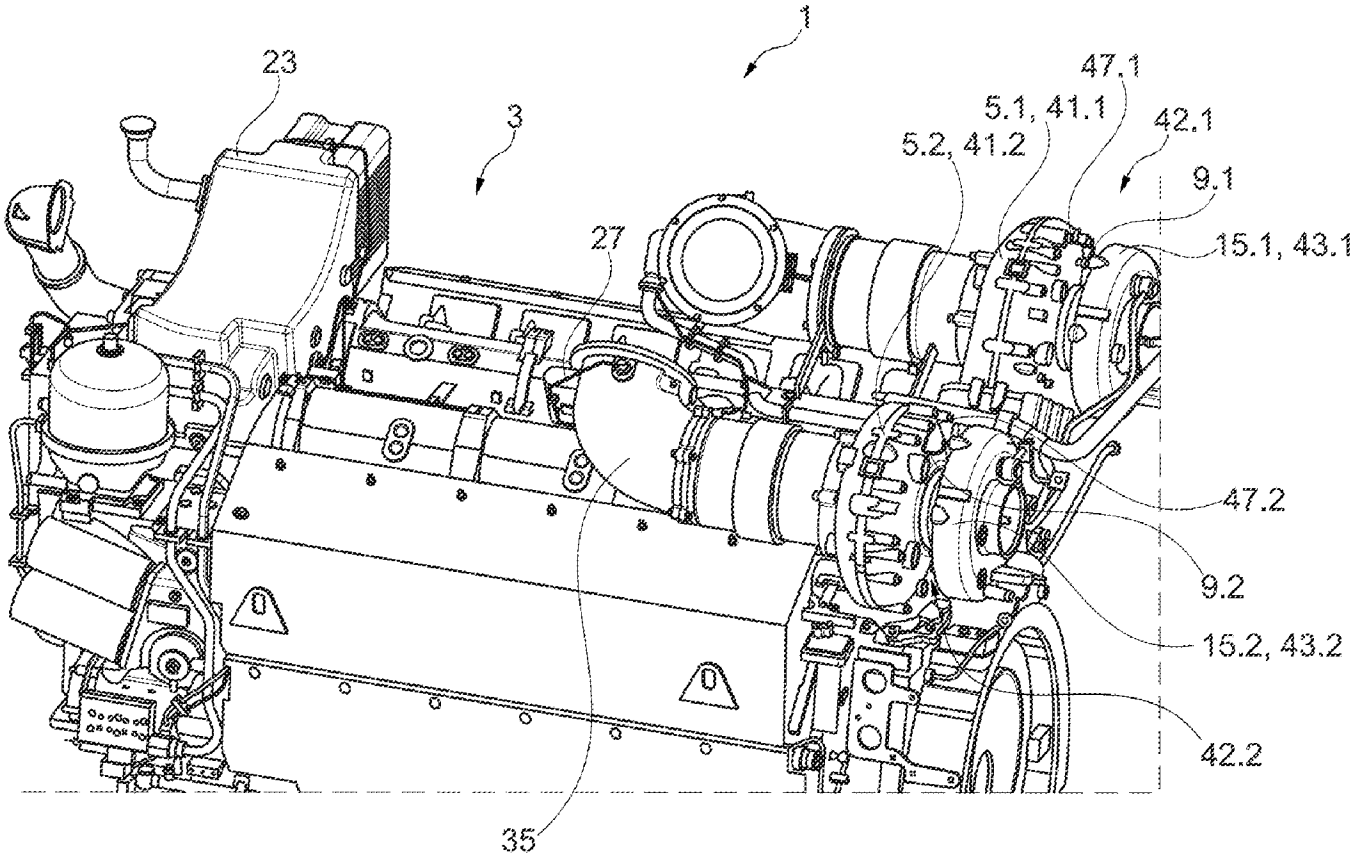
FIG. 2 is an illustration of another embodiment of an internal combustion engine with a cooling system.

FIG. 2 is an illustration of a second exemplary embodiment of an internal combustion engine 1 with a cooling system 3. Identical and functionally identical elements are denoted by the same reference designations, such that, in this respect, reference is made to the preceding description. Here, two exhaust-gas turbochargers 42.1, 42.2 are provided with in each case one turbine housing 41.1, 41.2 as respective first component 5.1, 5.2 to be cooled, wherein the first components 5.1, 5.2 are each ventilated through a very short, first ventilation line 9.1, 9.2 into a respective compressor housing 43.1, 43.2. Also illustrated is a further ventilation line 27, through which a coolant line (not illustrated) of an exhaust line 35 is ventilated. Furthermore, the expansion tank 23 is illustrated.

It becomes clear here that the first ventilation lines 9.1, 9.2 are fluidically connected to the first components 5.1, 5.2 at connection points 47.1, 47.2 which are arranged geodetically above opening-in points (not illustrated here) of the first coolant lines (likewise not illustrated), for example at a geodetically highest point of the first components 5.1, 5.2. This permits particularly efficient ventilation of the first components 5.1, 5.2. In general, ventilation lines can be arranged at geodetically upper, for example geodetically highest, points of components to be ventilated.

Figures 3, 3D:
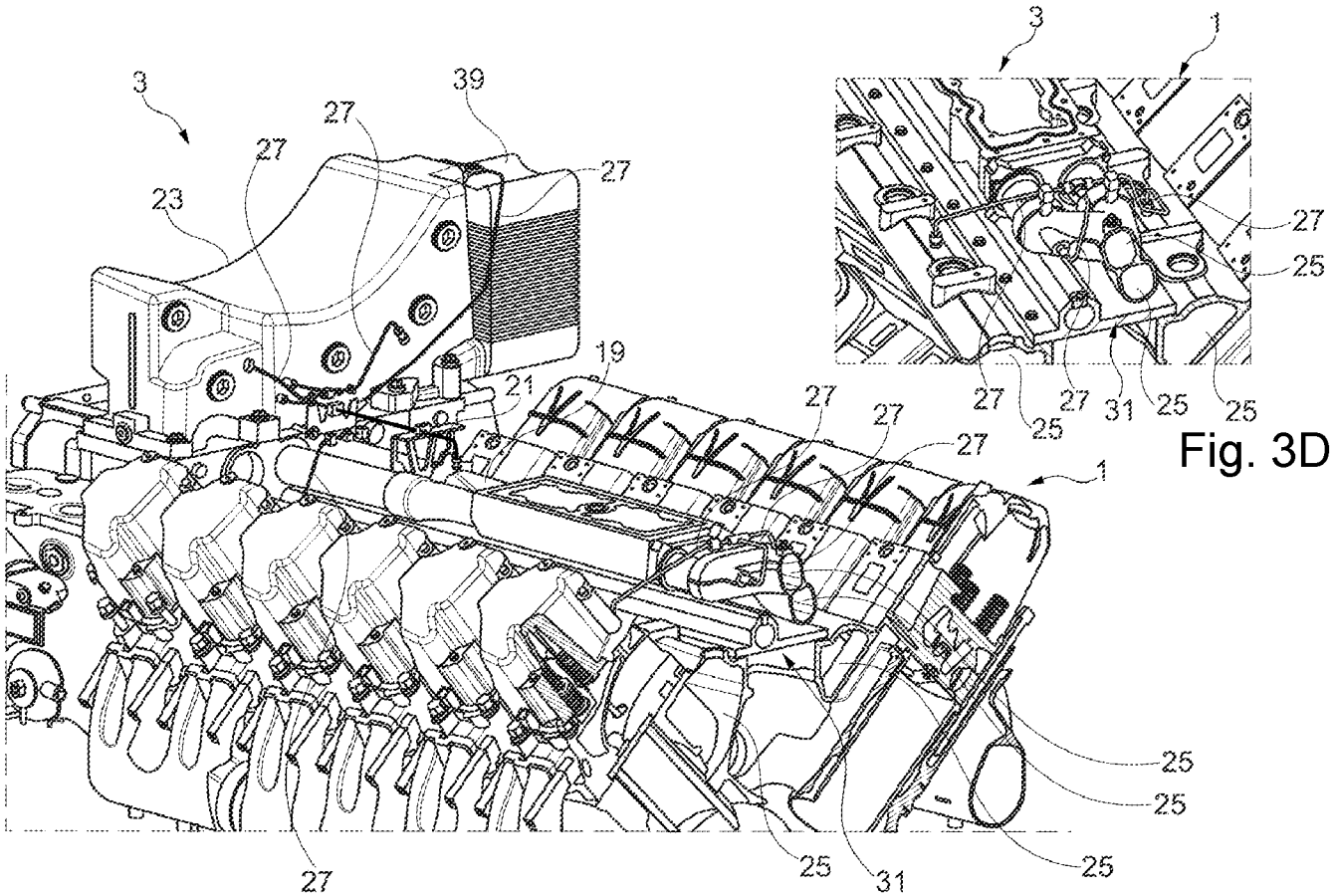
FIG. 3 is an illustration of another view of the internal combustion engine as per FIG. 2.
FIG. 3D is a detail view of the internal combustion engine as shown in FIG. 3.

FIG. 3 is an illustration of the embodiment of the internal combustion engine 1 with the cooling system 3 as per FIG. 2 from another perspective and with an enlarged detail FIG. 3D. Identical and functionally identical elements are denoted by the same reference designations, such that, in this regard, reference is made to the preceding description. Here, in particular, ventilation lines 27 are illustrated which branch off from a crankcase 31 and which open, upstream of an air separator 19, into a coolant line 25 which opens into the air separator, such that the air that is ventilated from the crankcase 31 is supplied through the coolant line 25 to the air separator 19. The air can then be separated from the coolant in the air separator 19 and can be supplied through the second ventilation line 21 to the collecting vessel 23.

Also illustrated are further ventilation lines 27 which lead directly into the collecting vessel 23 from other components to be cooled. For example, a ventilation line 27 leads from the oil heat exchanger 39 directly into the collecting vessel 23.

A comparison of FIGS. 2 and 3 shows that the crankcase 31 is arranged closer to the air separator 19 than the turbine housings 41.1, 41.2 as first components 5.1, 5.2 to be ventilated. It is therefore expedient for the crankcase 31 to be ventilated directly into a coolant line 25 which opens into the air separator 19, whereas the turbine housings 41.1, 41.2 are initially ventilated into the compressor housings 43.1, 43.2. Thus, where possible, use can be made of the shortest and fewest possible ventilation lines throughout.

Figure 4:
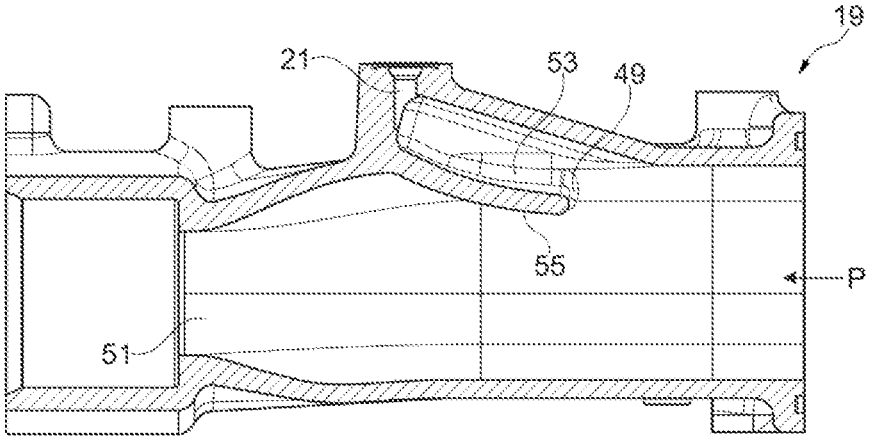
FIG. 4 is a sectional illustration through an embodiment of an air separator of an embodiment of a cooling system according to the present invention.

FIG. 4 shows an embodiment of the air separator 19. The air separator 19 has a separation means 49 which in this case is in the form of a lamella. Identical and functionally identical elements are denoted by the same reference designations, such that, in this respect, reference is made to the preceding description. The separation means 49 is designed to branch off air from a coolant flow passing through the air separator 19 along an arrow P and supply the air to the second ventilation line 21, which in this case is illustrated in the form of an opening-in bore into the air separator 19. Accordingly, a part 51 of the air separator 19 arranged downstream of the separation means 49 conducts little or even no air, such that, downstream of the air separator 19, efficient cooling of a component to be cooled is realized.

Air encompassed by the coolant, on its path through the air separator 19 and even before this through a coolant line 25 connected thereto, becomes concentrated geodetically at the top, for example on a geodetically upper, first side 53 of the separation means 49. The air thus always impinges on the separation means 49 so as to be conducted along the first side 53 into the second ventilation line 21 and be discharged from there. By contrast, the coolant flows along a geodetically lower, second side 55 of the separation means 49 through the air separator 19, and through that part 51 which is arranged downstream of the separation means 49, further along the coolant circuit.

It is possible for the air separator 19 to be arranged directly upstream of the coolant heat exchanger 45.

Altogether, it is shown that, by means of the cooling system 3 proposed here and the internal combustion engine 1, highly efficient cooling is possible, while avoiding long ventilation lines, which are susceptible to vibrations, and with optimized ventilation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cooling system, comprising:

a first coolant line and a second coolant line;

at least one first component to be cooled, into which the first coolant line opens, the at least one first component being in the form of a turbine housing of an exhaust-gas turbocharger;

a second component to be cooled, the second component being in the form of a compressor housing of the exhaust-gas turbocharger; and a first ventilation line fluidically connected to the at least one first component and configured for ventilating the at least one first component, the first ventilation line opens into the second coolant line, wherein the second coolant line is formed as a coolant path in the second component.

2. The cooling system of claim 1 wherein the first ventilation line opens into the second coolant line outside of at least one of said at least one first component and the second component to be cooled.

3. The cooling system of claim 1, wherein a first pressure prevails in the first coolant line, a second pressure prevails in the second coolant line, wherein the first pressure of the first coolant line is higher than the second pressure of the second coolant line.

4. The cooling system of claim 1, wherein said first coolant line has a first cross-sectional area, said first ventilation line has a second cross-sectional area, wherein the first cross-sectional area is larger than the second cross-sectional area by a factor of one of 16 to 400, 25 to 225, and 36 to 100.

5. The cooling system of claim 1, wherein said first ventilation line is fluidically connected to said at least one first component at a connection point which is arranged higher than an opening-in point of said first coolant line into said at least one first component.

6. The cooling system of claim 1, wherein the cooling system further includes an air separator which is arranged downstream of an opening-in point of the first ventilation line into the second coolant line.

7. The cooling system of claim 6, wherein the cooling system further includes a second ventilation line fluidically connected to said air separator.

8. The cooling system of claim 7, wherein said air separator has a separation means which is designed to separate air out of a coolant flow passing through the air separator and to supply said air to said second ventilation line.

9. The cooling system of claim 7, wherein the cooling system further includes an expansion tank, and at least one of the second coolant line and the second ventilation line open into said expansion tank of the cooling system.

10. The cooling system of claim 9, wherein the second coolant line is arranged spatially closer to said expansion tank than said at least one first component.

11. An internal combustion engine, comprising:

a cooling system, including:

a first coolant line and a second coolant line;

at least one first component to be cooled, into which the first coolant line opens, the at least one first component being in the form of a turbine housing of an exhaust-gas turbocharger;

a second component to be cooled, the second component being in the form of a compressor housing of the exhaust-gas turbocharger; and a first ventilation line fluidically connected to the at least one first component and configured for ventilating the at least one first component, the first ventilation line opens into the second coolant line, wherein the second coolant line is formed as a coolant path in the second component.

12. The internal combustion engine of claim 11, wherein said cooling system further includes a second component to be cooled, and said second coolant line is formed as a coolant path in the second component.

13. The internal combustion engine of claim 12, wherein the first ventilation line opens into the second coolant line outside of at least one of said at least one first component and the second component to be cooled.

14. The internal combustion engine of claim 11, wherein a first pressure prevails in the first coolant line, a second pressure prevails in the second coolant line, wherein the first pressure of the first coolant line is higher than the second pressure of the second coolant line.

15. The internal combustion engine of claim 11, wherein said first coolant line has a first cross-sectional area, said first ventilation line has a second cross-sectional area, wherein the first cross-sectional area is larger than the second cross-sectional area by a factor of one of 16 to 400, 25 to 225, and 36 to 100.

16. The internal combustion engine of claim 11, wherein said first ventilation line is fluidically connected to said at least one first component at a connection point which is arranged higher than an opening-in point of said first coolant line into said at least one first component.

17. The internal combustion engine of claim 11, wherein the cooling system further includes an air separator which is arranged downstream of an opening-in point of the first ventilation line into the second coolant line.

18. A cooling system, comprising:

a first coolant line and a second coolant line;

at least one first component to be cooled, into which the first coolant line opens; and a first ventilation line fluidically connected to the at least one first component and configured for ventilating the at least one first component, the first ventilation line opening directly into the second coolant line, wherein the second coolant line is formed as a coolant path in the second component such that air discharged from the at least one first component is not led directly to one of a bubble separator and an expansion tank.

* * * * *